US011589608B2

(12) United States Patent
Kitaoka

(10) Patent No.: US 11,589,608 B2
(45) Date of Patent: Feb. 28, 2023

(54) BIODEGRADABLE FILTER WITH IMPROVED TASTE

(71) Applicant: JT International S.A., Geneva (CH)

(72) Inventor: Ryo Kitaoka, Tokyo (JP)

(73) Assignee: JT International S.A.

( * ) Notice: Subject to any disclaimer, the term of this patent is extended or adjusted under 35 U.S.C. 154(b) by 200 days.

(21) Appl. No.: 16/957,298

(22) PCT Filed: Jan. 30, 2019

(86) PCT No.: PCT/EP2019/052220
§ 371 (c)(1),
(2) Date: Jun. 23, 2020

(87) PCT Pub. No.: WO2019/149742
PCT Pub. Date: Aug. 8, 2019

(65) Prior Publication Data

US 2020/0397040 A1 Dec. 24, 2020

(30) Foreign Application Priority Data

Feb. 1, 2018 (EP) ..... 18154642

(51) Int. Cl.

| | |
|---|---|
| ***A24D 3/14*** | (2006.01) |
| ***A24D 3/04*** | (2006.01) |
| ***A24D 3/02*** | (2006.01) |
| ***A24D 3/06*** | (2006.01) |
| ***A24D 3/10*** | (2006.01) |

(52) U.S. Cl.
CPC ..... *A24D 3/14* (2013.01); *A24D 3/0229* (2013.01); *A24D 3/0254* (2013.01); *A24D 3/048* (2013.01); *A24D 3/068* (2013.01); *A24D 3/10* (2013.01)

(58) Field of Classification Search
None
See application file for complete search history.

(56) References Cited

U.S. PATENT DOCUMENTS

| | | | | |
|---|---|---|---|---|
| 5,387,285 | A | 2/1995 | Rivers | |
| 2011/0094526 | A1 | 4/2011 | Marshall et al. | |
| 2012/0305015 | A1 | 12/2012 | Sebastian et al. | |
| 2015/0059789 | A1 | 3/2015 | Mccormack et al. | |
| 2015/0189913 | A1* | 7/2015 | Binassi ..... | A24D 3/068 131/331 |

FOREIGN PATENT DOCUMENTS

| | | | |
|---|---|---|---|
| CN | 1292237 | A | 4/2001 |
| CN | 1423981 | A | 6/2003 |

(Continued)

OTHER PUBLICATIONS

Search Report dated Mar. 23, 2022 from the Office Action for Chinese Application No. 201980009870.6 dated Mar. 31, 2022, pp. 1-3.

(Continued)

*Primary Examiner* — Dennis R Cordray
(74) *Attorney, Agent, or Firm* — Lerner, David, Littenberg, Krumholz & Mentlik, LLP

(57) ABSTRACT

A filter for a smoking article has improved biodegradability and improved taste during smoking of the smoking article. The filter includes a segment having a filtration substrate including natural cellulose fibres, and a wrapper at least partly surrounding the segment. The filtration substrate contains a composition including an additive for reducing phenols.

14 Claims, 6 Drawing Sheets

(56) References Cited

FOREIGN PATENT DOCUMENTS

| | | | |
|---|---|---|---|
| CN | 101805937 | A | 8/2010 |
| CN | 104244747 | A | 12/2014 |
| GB | 1199165 | A | 7/1970 |
| GB | 2474694 | A | 4/2011 |
| JP | H8140654 | A | 6/1996 |
| JP | 2013508569 | A | 3/2013 |
| JP | 2013514801 | A | 5/2013 |
| JP | 2014515933 | A | 7/2014 |
| JP | 2015523079 | A | 8/2015 |
| WO | 2009080368 | A1 | 7/2009 |
| WO | 2009093051 | A2 | 7/2009 |
| WO | 2011077138 | A1 | 6/2011 |
| WO | 2012012053 | A1 | 1/2012 |
| WO | 2012166302 | A2 | 12/2012 |
| WO | 2013068337 | A1 | 5/2013 |
| WO | 2013164623 | A1 | 11/2013 |
| WO | 2013164624 | A1 | 11/2013 |
| WO | 2014009498 | A1 | 1/2014 |
| WO | 2015124242 | A1 | 8/2015 |
| WO | 2017025924 | A1 | 2/2017 |

OTHER PUBLICATIONS

Extended European Search Report with Written Opinion for Application No. 18154642.5 dated Jul. 7, 2018, 8 pages.
International Search Report for Application No. PCT/EP2019/052220 dated Apr. 17, 2019, 4 pages.

* cited by examiner

BIODEGRADABLE FILTER WITH IMPROVED TASTE

CROSS-REFERENCE TO RELATED APPLICATIONS

The present application is a national phase entry under 35 U.S.C. § 371 of International Application No. PCT/EP2019/052220, filed Jan. 30, 2019, published in English, which claims priority to European Application No. 18154642.5 filed Feb. 1, 2018, the disclosures of which are incorporated herein by reference.

BACKGROUND ART

The present invention relates to a filter for a smoking article with improved biodegradability and improved taste during smoking of the smoking article.

Filters for smoking articles are typically made of cellulose acetate tow, which is particularly selective to filter phenols, but is slow to degrade, unless specially treated. Therefore, different materials have been tested as a replacement for cellulose acetate in filters for smoking articles.

For example, WO2015124242 shows a filter having a filtration material comprising polylactic acid. However, the present inventor found that also polylactic acid is not sufficiently biodegradable.

A further alternative filtration material that is biodegradable is paper. For example, WO2012012053 shows a filter with a paper substrate. However, this document teaches that the taste profile of a smoking article comprising a filter having a paper substrate is different to that of a smoking article with a cellulose acetate based filter.

Therefore there exists a need to provide a biodegradable filter for a smoking article with a good taste profile.

BRIEF DESCRIPTION OF THE INVENTION

It was found that semi-volatile compounds are key components for the taste in a smoking article, e.g. a cigarette. In this regard it is known that a cellulose acetate filter has a high filtration property of semi-volatile components. The inventor found that filters based on natural cellulose fibres do not have such a high filtration property. Thus, the bad taste, e.g. having increased harshness and dryness compared to cellulose acetate filters, may be derived from semi-volatile components, like phenols, that are not filtered by the cellulose. In this regard, the inventor found that paper is not selective to filter phenols, resulting in a worse taste upon smoking compared to the same cigarette with a cellulose acetate filter.

The inventor has further identified that phenols can be filtered by impregnating a filtration substrate (filter substrate, i.e. substrate for at least a segment of a filter for a smoking article), e.g. a paper substrate, with additives for reducing phenols like triacetin. He further particularly found that the amount of additive for reducing phenols can be suitably selected to achieve a similar taste as the one obtained with a cellulose acetate filter.

In a first aspect the present invention relates to a filter for a smoking article, the filter comprising: a segment comprising a filtration substrate comprising natural cellulose fibres, the filtration substrate containing a composition comprising an additive for reducing phenols; and a wrapper at least partly surrounding the segment.

Furthermore disclosed is a smoking article comprising the filter of the present invention.

In addition, the present invention is directed to a method for producing a filter rod, the method comprising the steps of:

- providing a filtration substrate comprising natural cellulose fibres;
- forming the filtration substrate into a continuous rod;
- applying a composition to the filtration substrate, the composition comprising an additive for reducing phenols;
- wrapping the continuous rod with a continuous band of wrapping material; and
- cutting the wrapped continuous rod to obtain filter rods of a predetermined rod length.

Moreover, a method for producing a filter segment for a filter of the present invention is disclosed, the method comprising the steps of:

- providing a filter rod obtained by the present method of producing filter rods; and
- cutting the filter rod to obtain a filter segment of a predetermined segment length.

Further aspects and embodiments of the invention are disclosed in the dependent claims and can be taken from the following description and examples, without being limited thereto.

FIGURES

The enclosed drawing should illustrate embodiments of the present invention and convey a further understanding thereof. In connection with the description it serves as explanation of concepts and principles of the invention. Other embodiments and many of the stated advantages can be derived in relation to the drawing.

Figure 5:
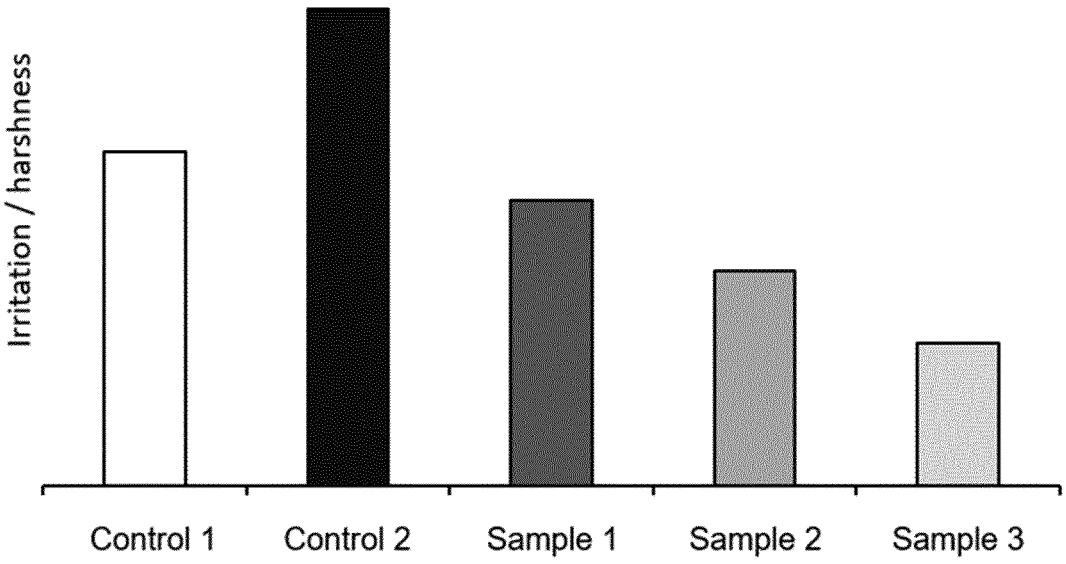

In FIG. 5 the results of a taste test in Example 3 are depicted.

FIGS. 6*a-d* show results of a leakage test in Example 4.

DETAILED DESCRIPTION OF THE INVENTION

Definitions

Unless defined otherwise, technical and scientific terms used herein have the same meaning as commonly understood by one of ordinary skill in the art to which this invention belongs.

The term "phenols" refers to a class of compounds wherein one or more hydroxyl group is bound to an aromatic hydrocarbon groups. Examples thereof include phenol, o-cresol, m-cresol, p-cresol, catechol. An "additive for reducing phenols" is thus an additive that is capable of reducing at least one of the phenols, e.g. phenol, o-cresol, m-cresol, p-cresol, and/or catechol, etc. when the present filter is used for filtering a smoke resulting from burn or non-burn applications, as can be e.g. determined using a standard smoking test.

Herein, the terms "filtration substrate comprising natural cellulose fibres" and "filtration substrate" are corresponding to each other, unless it is clear from context otherwise.

All values given in the present disclosure are to be understood to be complemented by the word "about", unless it is clear to the contrary from the context.

As used herein, wt. % is to be understood as weight percent. In the present disclosure, all amounts are given in wt. %, unless clearly stated otherwise or obvious from context. In the present disclosure, furthermore all amounts given in wt. % in a particular embodiment add up to 100 wt. %. The weight percent are thereby calculated by dividing the mass of each component by the total mass in the respective embodiment, unless indicated otherwise or clear from context.

In a first aspect the present invention relates to a filter for a smoking article, the filter comprising:

a segment comprising a filtration substrate comprising natural cellulose fibres, the filtration substrate containing a composition comprising an additive for reducing phenols; and a wrapper at least partly surrounding the segment.

The present filter can consist of one or more segments and is not particularly restricted in this regard, as long as it contains at least one segment comprising a filtration substrate comprising natural cellulose fibres which contains a composition comprising an additive for reducing phenols. Also more than one of these segments can be contained in the present filter, e.g. separated by a further segment. The present filter can be e.g. a mono filter, a dual filter, a triple filter, a single or multi cavity filter, or a filter with combinations of any of the above. The further segments are not particularly restricted.

Preferably, the external diameter of filters and smoking articles according to the present invention is between about 4 mm and 9 mm, more preferably between about 5 mm and 8 mm, for example, of about 5.3 mm, about 6.9 mm, or about 7.7 mm.

Preferably, the overall length of filters according to the present invention is between about 11 mm and about 40 mm, more preferably between about 17 mm and 30 mm, for example, of about 21 mm, about 27 mm, or about 30 mm.

Preferably, the length of each individual segment of filters with more than one filter segment according to the present invention is between about 5 mm and about 22 mm.

In the present invention, particularly for the filtration substrate, the natural cellulose fibres are not particularly restricted as long as they are obtained from natural sources, e.g. plants. Suitable natural cellulose fibres include for example those obtained from flax, bagasse, esparto, straw, cotton, papyrus, bamboo, jute, hardwoods, and softwoods. The natural cellulose fibres can also be from more than one source. For example, they can be from several woods.

Further, also the filtration substrate is not particularly restricted. For example, the filtration substrate may comprise natural cellulose fibres in woven or non-woven forms or in the form of filaments, but preferably is non-woven or in the form of filaments for easier production of the filter. According to certain embodiments, the filtration substrate is obtained from wood pulp. According to certain embodiments, the filtration substrate does essentially not contain cellulose acetate fibres, and particularly does not contain cellulose acetate fibres.

According to certain embodiments, the filtration substrate may be provided in sheet-like form, e.g. as a paper. In these embodiments the filtration substrate, e.g. paper, may be formed into a continuous rod by rolling, crimping, corrugating, or folding. According to preferred embodiments, the filtration substrate is paper, preferably corrugated paper, so that the composition comprising the additive for reducing phenols can be easily applied and retained, and the filter can be easily produced.

According to certain embodiments, the filtration substrate may be provided in filamentary form, for example in the form of a woven or non-woven substrate. In these embodiments the filtration substrate may be formed into a continuous rod by fluffing the woven substrate and passing it through a shaped funnel under tension. It may also be provided in randomly oriented form.

In preferred embodiments, the filtration substrate is a sheet-like material comprising the natural cellulose fibres, e.g. a paper-based material, particularly paper. The sheet-like material may also include lignin. Further, the sheet-like material may also comprise hemicellulose, e.g. glucuronoxylan, arabinoxylan, glucomannan, and xyloglucan, and mixtures thereof. Furthermore, the sheet like material may also include a filler material, which may be selected from the group consisting of calcium carbonate, kaolin, clay, talc, titanium dioxide, alumina trihydrate, precipitated silica and silicates (PSS), or mixtures thereof.

According to certain embodiments, the sheet-like material, e.g. paper, comprises:

natural cellulose fibres in an amount of 40 to 100 wt. %, lignin in an amount of 0 to 20 wt. %, hemicellulose in an amount of 0 to 20 wt. %, and a filler material in an amount of 0 to 55 wt. %, wherein the wt. % in the sheet-like material is a percentage based on the total dry basis weight of the sheet-like material.

The sheet-like material may have a dry basis weight in the range of 5 to 130 g/m$^2$, preferably 10 to 110 g/m$^2$. In some embodiments the sheet-like material may have a dry basis weight in the range of 25 to 80 g/m$^2$, such as of 30 to 60 g/m$^2$. If the basis weight is too low, filter production may be difficult due to a low tensile strength thereof. If basis weight is too high, the flexibility of the sheet-like material may be too low and no appropriate pressure drop may be achieved.

The sheet-like material may have a filtration speed of no more than 36,000 s/10 ml, measured according to DIN 53 137. In preferred embodiments, the sheet-like material may have a filtration speed of between 0.1 s/10 ml and 300 s/10 ml, such as in the range 1 s/10 ml to 5 s/10 ml, e.g., 2 s/10 ml.

In the present filter, the additive for reducing phenols is not particularly restricted. According to certain embodiments, the additive for reducing phenols is chosen from triacetin, triethyl citrate (TEC), propylene glycol, polyethylene glycol—having e.g. a weight average molecular weight of between 100 and 8 000 daltons, polypropylene glycol—having e.g. a weight average molecular weight of between 100 and 8 000 daltons, and mixtures thereof. Preferably the additive for reducing phenols comprises triacetin. Further preferably, the additive for reducing phenols is triacetin.

In the present filter, the wrapper at least partly surrounding the segment is not particularly restricted and can comprise one or more layers. It can comprise the segment of the whole filter partly or preferably in whole. If more than one segment is contained then wrappers can be provided for more than one or even all separate segments, and/or a wrapper can be provided over all segments of the filter. More than one wrapper can also be provided for the filter. For a good biodegradability, the wrapper may be made of a biodegradable material, like natural cellulose-based materials, e.g. paper, cardboard, etc. It may be printed, embossed, debossed, embellished, etc. A preferable material for the wrapper is paper.

According to certain embodiments, the composition further comprises a binding agent or binder for binding the additive for reducing phenols to the filtration substrate. The binding agent is added for increasing the viscosity of the composition (comprising the additive for reducing phenols and the binding agent), thus stabilizing the additive for reducing phenols further in the filter.

According to certain embodiments, the composition comprises less than 20 wt. % of the binding agent, based on the total weight of the composition, i.e. the composition comprising the additive for reducing phenols and the binding agent, particularly a composition essentially consisting of or even consisting of the additive for reducing phenols and the binding agent. In certain preferred embodiments, the composition comprises 0.5 to 15 wt. %, preferably 1.5 to 10 wt. %, particularly preferably 2 to 8 wt. % of the binding agent, e.g. 2, 4 or 8 wt. %, based on the total weight of the composition. According to certain embodiments, the composition consists essentially of, preferably consists of, the additive for reducing phenols, particularly triacetin, and the binding agent, particularly cellulose acetate. In such cases, the remainder to 100 wt. % in the composition is the additive for reducing phenols. If the amount of the binding agent is too low, there is a risk of leakage of the additive for reducing phenols to the wrapper, and if the amount of the binding agent is too high, the viscosity increase is too high, making the filter production in a filter making machine difficult. If the amount of binding agent is too high, the viscosity of the composition comprising the additive for reducing phenols and the binding agent may become too high, making production of the filter difficult. If the amount of the binding agent is too low, the retention of the additive for reducing phenols on the filtration substrate is reduced. A higher amount of binding agent can reduce the leakage amount of the additive for reducing phenols, e.g. upon storage.

According to certain embodiments, the dynamic viscosity of the composition comprising the additive for reducing phenols and the binding agent is below 5 000 mPas, measured at 50° C. and normal pressure of 101 325 Pa. The dynamic viscosity is measured using a rotational viscometer according to ISO 3219:1993. In certain preferred embodiments, the dynamic viscosity of the composition comprising the additive for reducing phenols and the binding agent is between 50 and 1 500 mPas, preferably between 300 and 1 000 mPas, at 50° C. and normal pressure of 101 325 Pa. In this way, spraying of the composition for producing the present filter is eased and more complex application processes, such as direct injection, can be avoided.

According to certain embodiments, the binding agent is contained in an amount of less than 7 wt. %, based on the total weight of the filtration substrate and the composition comprising the additive for reducing phenols and the binding agent. According to certain preferred embodiments, the binding agent is contained in an amount of between 0.2 and 5.0 wt. %, preferably between 0.4 and 4.0 wt. %, further preferably between 0.6 and 3.3 wt. %, particularly preferably between 0.8 and 2.6 wt. %, based on the total weight of the filtration substrate and the composition comprising the additive for reducing phenols and the binding agent.

According to certain embodiments, the binding agent is cellulose acetate. The cellulose acetate is therein not particularly restricted. According to certain embodiments, the degree of substitution of the cellulose acetate is between 2.1 and 2.9, preferably between 2.1 and 2.6, e.g. about 2.4. A suitable degree of substitution allows a good affinity to the filtration substrate as well as the additive for reducing phenols, particularly triacetin, thus reducing leakage of the additive for reducing phenols, particularly triacetin, to the wrapper. The shape of the cellulose acetate is not particularly restricted, and it can be in the form of fibres, e.g. short fibres, particles, flakes, etc., as it is preferably dissolved in the additive for reducing phenols, particularly triacetin, particularly before it is applied to the filtration substrate. Particularly triacetin allows a dissolution of the cellulose acetate as binding agent, as well as a good reduction of phenols.

The degree of substitution (DS) of a polymer as used herein refers to the average number of substituent groups attached per base unit, in the case of condensation polymers, or per monomeric unit, in the case of addition polymers. In the particular case of cellulose acetate, the degree of substitution of the cellulose acetate refers to the average number of substituent groups attached per monomeric unit.

According to certain embodiments, a ratio of the binding agent to the total weight of the filtration substrate is 0.5% or higher, preferably 0.8% or higher, particularly preferably 1% or higher. The inventor found that the binding agent in the present filter does not only function as a carrier for the additive for reducing phenols, but also can function as a thickener for the composition comprising the additive for reducing phenols, i.e. increase the viscosity of the composition, thus leading to a better retention of the composition in the filtration substrate and reduced leakage.

According to certain embodiments, the composition is contained in an amount such that the filtration selectivity of the filter segment for phenol over total particulate material is at least 2, where the filtration selectivity $S_x$ (for phenol) is defined by the formula:

$$S_X = \frac{1 - E[TPM]}{1 - E[\text{Phenol}]}$$

where E[TPM] is the filtration efficiency of the filter segment for total particulate material, and E[Phenol] is the filtration efficiency of the filter segment for phenol. In this regard, the filtration efficiency E[TPM] can be measured in accordance with ISO4387:2000, whereas the filtration efficiency for phenol E[phenol] (or any other substance) can be also measured after a smoking run in line with ISO4387:2000, followed by extraction of the Cambridge filter and determining the value thereof by gas chromatography analysis. According to the above formula, of course also filtration selectivities for other substances like o-cresol, etc. can be calculated by replacing the filtration efficiency for phenol E[Phenol] by the filtration efficiency of the other substance, e.g. E[o-cresol] for o-cresol. In other words, the filtration selectivity, Sx, is calculated based on the filtration efficiency of the filter for total particulate matter, which excludes the gas and vapours in smoke that pass through a Cambridge filter pad on the smoking machine. The filtration efficiency is calculated by comparison of a component's amount caught by the Cambridge filter pad in the smoking machine with a tobacco rod with and without filter.

According to certain embodiments, the filter may comprise additionally granules like charcoal, and/or flavour particles. The form and amount thereof are not particularly restricted and may comprise the amounts, sizes, and other usual parameters as usually used in filters for smoking articles, e.g. cigarette filters.

According to certain embodiments, the present filter comprises at least a segment comprising a filtration substrate comprising natural cellulose fibres, e.g. paper, comprising triacetin and cellulose acetate, and a wrapper at least partly surrounding the segment. According to certain embodiments, the present filter essentially consists of or consists of a filtration substrate comprising natural cellulose fibres, e.g. paper, triacetin and cellulose acetate, and a wrapper, e.g. a paper wrapper.

According to certain embodiments, the composition is contained in an amount of 10 to 35 wt. %, based on the total weight of the filtration substrate and the composition, i.e. the composition comprising the additive for reducing phenols and optionally the binding agent, particularly the composition comprising the additive for reducing phenols and the binding agent. According to certain preferred embodiments, the composition may be contained in an amount of 10 to 13 wt. %, in an amount of 20 to 24 wt. %, or in an amount of 30 to 35 wt. %, e.g. about 10 wt. %, between 20 and 21 wt. %, between 30 and 32 wt. %, based on the total weight of the filtration substrate and the composition.

According to certain embodiments, the additive for reducing phenols is contained in an amount of between 9 and 35 wt. %, based on the total amount of the filtration substrate and the composition comprising the additive for reducing phenols and the binding agent. According to certain preferred embodiments, the additive for reducing phenols is contained in an amount of between 9 and 11 wt. %, in an amount between 19 and 21 wt. %, or in an amount between 28 and 32 wt. %, based on the total amount of the filtration substrate and the composition comprising the additive for reducing phenols and the binding agent. A higher amount of additive for reducing phenols enables a better reduction of phenols in a smoke comprising these. However, if the amount is too high, there is a risk of leakage of the additive for reducing phenols. If the amount of the additive for reducing phenols is too low, phenols cannot be sufficiently reduced.

Furthermore disclosed is a smoking article comprising the filter of the present invention. In the smoking article the further components apart from the filter are not particularly limited and can comprise components that are usually used in smoking articles.

Apart from the filter the smoking article can, for example, comprise an aerosol generating substrate, e.g. a tobacco rod in cigarettes, or an aerosol generating, e.g. tobacco or nicotine containing, substrate in non-burn applications, e.g. where the tobacco or nicotine is only heated but not combusted. If the smoking article is e.g. a cigarette, a tipping paper may be present to connect the tobacco rod and the filter.

Also disclosed is a method for producing a filter rod, the method comprising the steps of:

- providing a filtration substrate comprising natural cellulose fibres;
- forming the filtration substrate into a continuous rod;
- applying a composition to the filtration substrate, the composition comprising an additive for reducing phenols;
- wrapping the continuous rod with a continuous band of wrapping material; and
- optionally cutting the wrapped continuous rod to obtain filter rods of a predetermined rod length.

Preferably the method is carried out in this order. With the present method, particularly the present filter or at least a segment thereof can be produced. Thus, the respective features discussed with regard to the filter also apply for the present method for producing a filter rod.

The steps of providing the filtration substrate; forming the filtration substrate into a continuous rod—which is not particularly restricted regarding size, circumference, etc., and can be as in usual filters for smoking articles; applying the composition to the filtration substrate; wrapping the continuous rod; and cutting the wrapped continuous rod are not particularly restricted and can be carried out as in a usual filter making process for smoking articles.

In some embodiments, the filtration substrate may be provided in sheet-like form. In these embodiments the filtration substrate may be formed into a continuous rod by rolling, crimping, corrugating, or folding, all of which are not particularly restricted.

In other embodiments, the filtration substrate may be provided in filamentary form, for example in the form of a woven substrate. In these embodiments the filtration substrate may be formed into a continuous rod by fluffing the woven substrate and passing it through a shaped funnel under tension. If the filtration substrate is provided in filamentary form, it can be formed to a continuous rod using common machinery, e.g. Turmalin filter making machine from Hauni Maschinenbau AG, as e.g. described in WO 2009/080368, WO 2009/093051, WO 2013/068337, WO 2013/164624 and WO 2013/164623.

According to certain embodiments, the step of applying the composition to the filtration substrate is performed during or after the step of forming the filtration substrate into a rod. According to certain embodiments, the step of applying the composition to the filtration substrate is performed during or after the step of wrapping the rod. In these instances, the composition can be e.g. injected as a fluid into the continuous rod or segments thereof, as e.g. described in U.S. Pat. No. 5,387,285.

According to certain embodiments, the step of applying the composition to the filtration substrate is performed before the step of forming the filtration substrate into a rod.

According to certain embodiments, the step of applying the composition to the filtration substrate comprises spraying the composition onto the filtration substrate. The spraying is not particularly restricted. Spraying is particularly useful if the composition is applied before the filtration substrate is formed into a (continuous) rod.

According to certain embodiments, the composition is heated before or during the step of applying the composition to the filtration substrate. Preferably, this step is carried out when the composition comprises an additive for reducing phenols and a binding agent. The composition may be heated up to a temperature of between 40° C. and 60° C., e.g. at about 50° C. and applied at that temperature. Preferably, the composition is applied under normal pressure of 101325 Pa.

Moreover disclosed is a method for producing a filter segment for a filter of the present invention, the method comprising the steps of:

- providing a filter rod obtained by the present method for producing a filter rod; and
- cutting the filter rod to obtain a filter segment of a predetermined segment length.

Preferably the method is carried out in this order. With the present method for producing a filter segment, particularly a segment for the present filter can be produced. Thus, the respective features discussed with regard to the filter also apply for the present method for producing a filter segment.

The cutting of the filter rod is not particularly restricted and can be carried out as is usual in producing filter segments. A suitable cutting length may be, for example, between 80 mm and 150 mm, such as of about 108 mm, or about 120 mm.

The above embodiments can be combined arbitrarily, if appropriate. Further possible embodiments and implementations of the invention comprise also combinations of features not explicitly mentioned in the foregoing or in the following with regard to the examples of the invention. Particularly, a person skilled in the art will also add individual aspects as improvements or additions to the respective basic form of the invention.

EXAMPLES

The present invention will now be described in detail with reference to examples thereof. However, these examples are illustrative and do not limit the scope of the invention.

Example 1

At a temperature of 22° C., filters for a cigarette were produced by dropping triacetin (GTA, glycerin triacetate) as additive for reducing phenols with different amounts of cellulose acetate on a filtration substrate made of a paper sheet that was crimped into a rod shape and wrapped with a standard paper wrapper. The degree of substitution of the cellulose acetate was 2.4. The paper sheet had a basis weight of 39 g/m$^2$, a thickness of 120 μm, and a filtration speed of 3.5 s/10 ml, which was measured according to DIN 53 137. The filter rods had a length of 126 mm and a diameter of 24.2 mm, and where cut into 6 filters of 21 mm in length.

The different amounts of added composition and the amount of binding agent present in the composition for different samples are given in the following table 1.

TABLE 1

Amounts for filter rods in Example 1:

| Sample number | cellulose acetate (CA) amount, based on total mass of CA and triacetin [wt. %] | filtration substrate [mg] | triacetin and CA [mg] | total filter weight including wrapper [mg] |
|---|---|---|---|---|
| 1 | 0 | 215.67 | 24.27 | 338.77 |
| 2 | | 215.50 | 53.73 | 370.23 |
| 3 | | 214.03 | 94.37 | 409.27 |
| 4 | 2 | 215.73 | 23.47 | 340.70 |
| 5 | | 214.97 | 52.13 | 368.30 |
| 6 | | 216.30 | 92.87 | 410.70 |
| 7 | 4 | 215.00 | 23.17 | 339.10 |
| 8 | | 215.40 | 54.37 | 369.37 |
| 9 | | 215.80 | 95.63 | 410.87 |
| 10 | 8 | 215.43 | 24.27 | 339.37 |

The produced filters were stored for 10 days and 1 month, respectively, at 22° C., standard pressure and 60% relative humidity, and the loss of additive observed as weight difference. In this regard it is noted that already liquid loss could be observed on the cardboard the filters were stored upon.

The results thereof are shown in Table 2, where leakage amount corresponds to the weight difference measured for each sample.

TABLE 2

Results of additive leakage

| | Storage duration | | | |
|---|---|---|---|---|
| | 10 days | | 1 Month | |
| Sample number | Leakage amount [mg] | Leakage [%] | Leakage amount [mg] | Leakage [%] |
| 1 | 2.73 | 11% | 3.10 | 13% |
| 2 | 7.90 | 15% | 7.50 | 14% |

TABLE 2-continued

Results of additive leakage

| | Storage duration | | | |
|---|---|---|---|---|
| | 10 days | | 1 Month | |
| Sample number | Leakage amount [mg] | Leakage [%] | Leakage amount [mg] | Leakage [%] |
| 3 | 8.73 | 9% | 9.07 | 10% |
| 4 | 1.80 | 8% | 2.97 | 13% |
| 5 | 2.70 | 5% | 6.07 | 12% |
| 6 | 4.50 | 5% | 8.13 | 9% |
| 7 | 0.97 | 4% | 2.47 | 11% |
| 8 | 0.20 | 0% | 3.30 | 6% |
| 9 | 1.40 | 1% | 4.13 | 4% |
| 10 | 0.20 | 1% | 0.57 | 2% |

Figure 1:
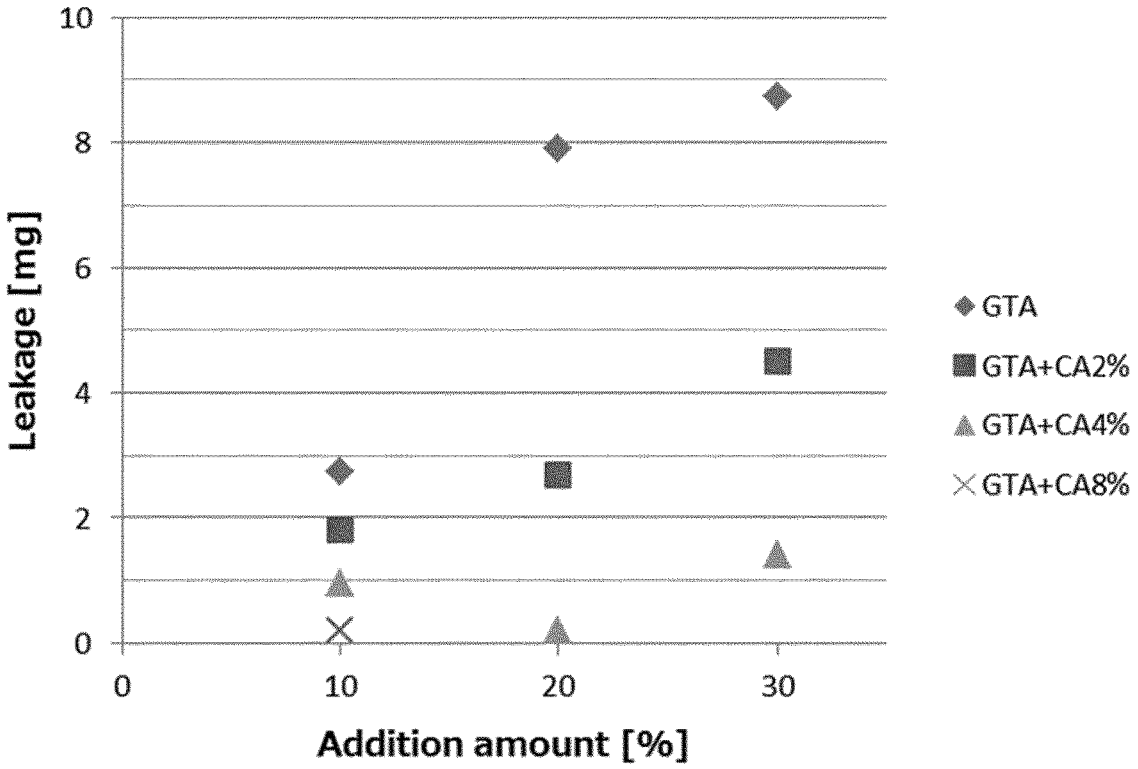
FIGS. 1 and 2 show results of a leakage test in Example 1.
Figure 2:
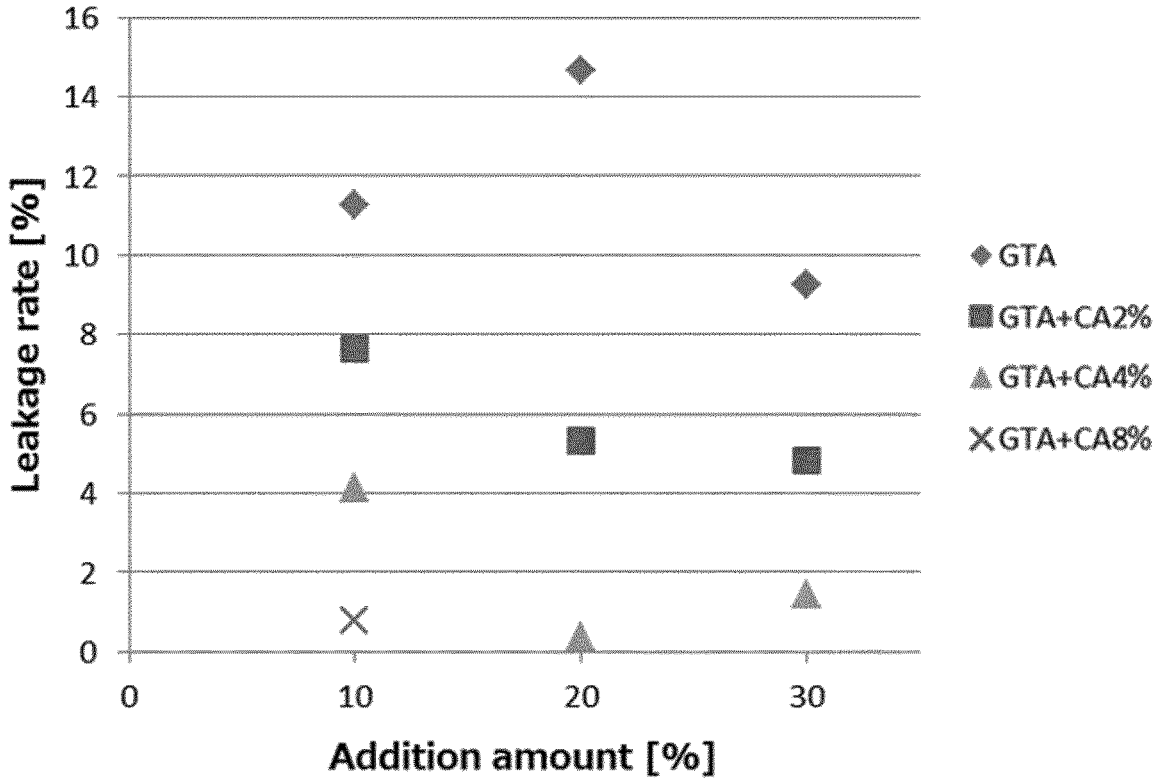

For the 10 days storage, the leakage results are also shown in FIGS. 1 and 2.

As can be seen, higher amounts of cellulose acetate lead to a reduced leakage of additive. Samples 6, 8, 9, and 10 resulted in a leakage of less than 10% after 1 month of storage, with samples 8, 9, 10 performing particularly well when compared to the other samples.

The inventor observed that when cellulose acetate was contained in an amount of 0.6 wt. % or higher, based on the total weight of the filtration substrate and the composition comprising the triacetin and the cellulose acetate, leakage after 1 month is below 10%. The inventor also observed that when cellulose acetate was contained in an amount of 0.8 wt. % or higher, based on the total weight of the filtration substrate and the composition comprising the triacetin and the cellulose acetate, leakage after 1 month is notoriously reduced.

The inventor observed that when cellulose acetate was contained in a ratio to the total weight of the filtration substrate (excluding the weight of the triacetin and the cellulose acetate) of 0.8 wt. % or higher, leakage after 1 month is below 10%. The inventor also observed that when this ratio was of to 1.0 wt. % or higher, leakage after 1 month is notoriously reduced.

Example 2

Filter samples 1 to 9 (sample 1-9) were tested against two control filters of substantially the same dimensions to determine their filtration efficiency in terms of phenol, o-cresol, and total particulate material (TPM). To this end, filter samples 1 to 9, as well as controls 1 and 2, were connected to a tobacco rod with a tipping paper and tested in a standard smoking test, wherein the filtration efficiency for phenol, o-cresol and total particulate material (TPM) was determined by measuring the amounts of phenol, o-cresol and TPM on the Cambridge filter.

Control filter 1 (control 1) was a standard cellulose acetate filter made from a tow of cellulose acetate fibres with a denier per filament of 2.5, and a total denier of 31,000. The fibres were Y shaped. Triacetin was added to the cellulose acetate fibres in an amount of 8 wt. %, based on the total weight of the cellulose acetate fibres and the triacetin. Control filter 2 (control 2) was a filter made of the same paper sheet material of filter samples 1 to 9, but without the additive for reducing phenols and without the binding agent.

Figure 3:
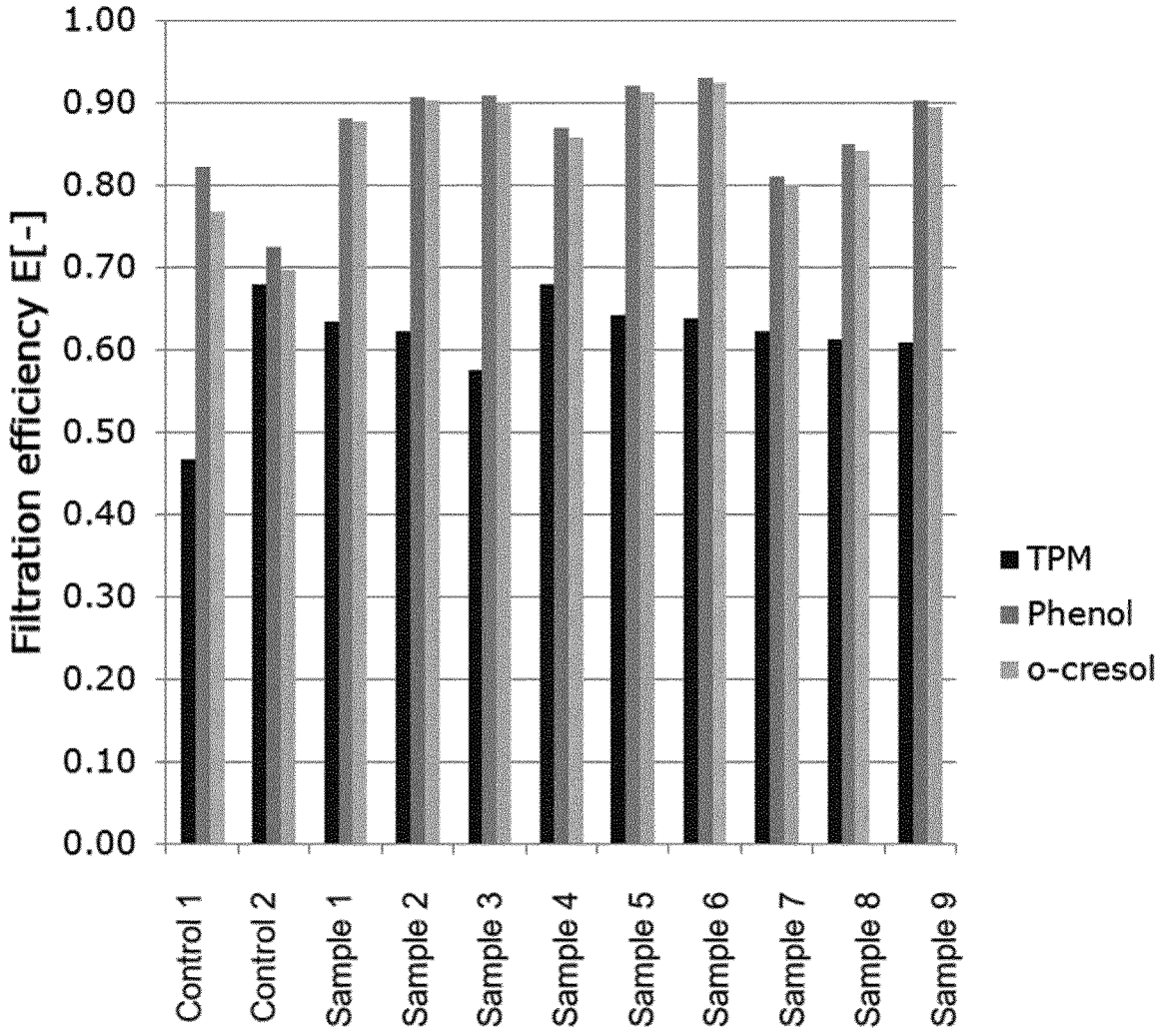
FIGS. 3 and 4 show results of filtration efficiency and selectivity in Example 2.

The results thereof are shown in FIG. 3.

Further, the filtration selectivity for phenol and o-cresol were determined by the formula given above. The results thereof are shown in FIG. 4.

Figure 4:
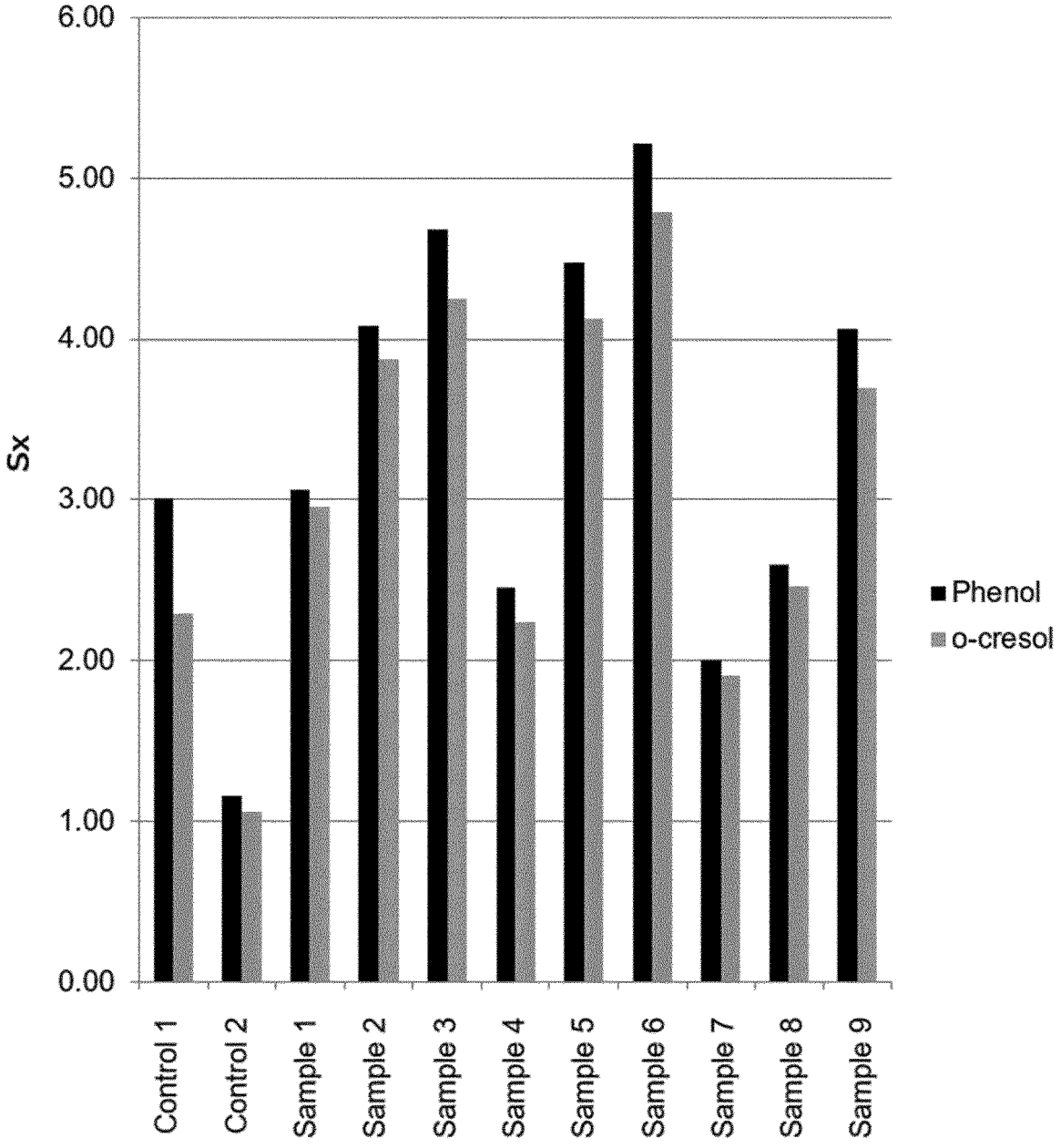

As can be seen from FIGS. 3 and 4, the addition of triacetin, and particularly of triacetin and cellulose acetate could increase the filtration efficiency and selectivity for phenol and o-cresol, resulting in efficiencies and selectivities similar to and even surpassing those of a cellulose acetate filter. The addition of cellulose acetate leads to a decreased selectivity for phenol and o-cresol.

Example 3

The cigarettes produced in Example 2 with filter samples 1, 2 and 3 were submitted to a sensory evaluation by a panel of five adults and compared to the cigarettes produced in Example 2 with the control filters.

After smoking, the panel evaluated the cigarettes for irritation/harshness during smoking. The results thereof are shown in FIG. 5. As can be seen from the Figure, the addition of triacetin resulted in a reduction of the irritation of the smoke, resulting in a smoother smoke with higher roundness and lower harshness. Thus, the smoothness of the smoke can be controlled by the applied amount of additive for reducing phenols.

Example 4

3 filter samples according to the invention and a control filter (control 3) were prepared to evaluate additive leakage over a longer period of time than that of Example 1. The filter samples and the control filter were prepared with a same paper sheet material as a filtration substrate to which different amounts of additive composition were added. The additive composition consisted of triacetin and cellulose acetate exclusively. No additive composition was added to the control filter (control 3). In this example, the amount of triacetin applied to the paper sheet material was determined by the weight ratio of cellulose acetate to filtration substrate and the amount of cellulose acetate in the composition. These amounts are given in the following table 3.

TABLE 3

Amounts for filter rods in Example 4:

| Sample number | cellulose acetate (CA) amount, based on total mass of CA and triacetin [wt. %] | weight ratio of cellulose acetate to filtration substrate [wt. %] |
|---|---|---|
| 11 | 4 | 0.50 |
| 12 | 4 | 1.03 |
| 13 | 6 | 1.57 |

Figure 6C:
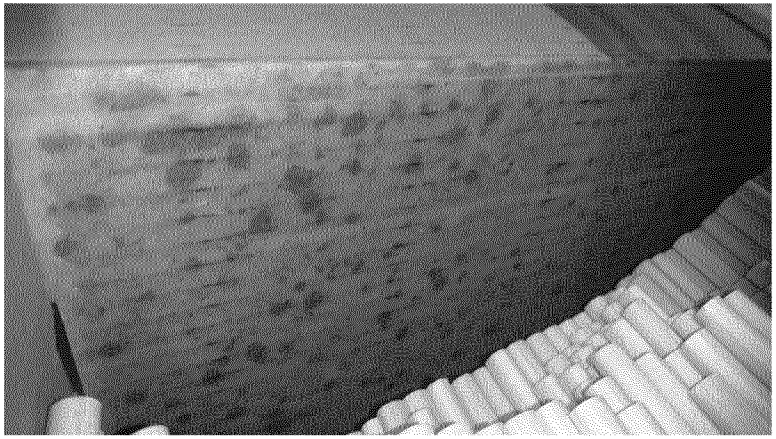
Figure 6D:
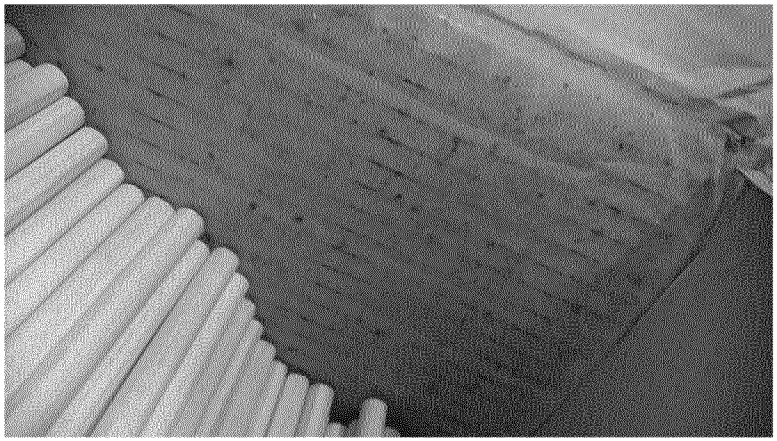
Figure 6A:
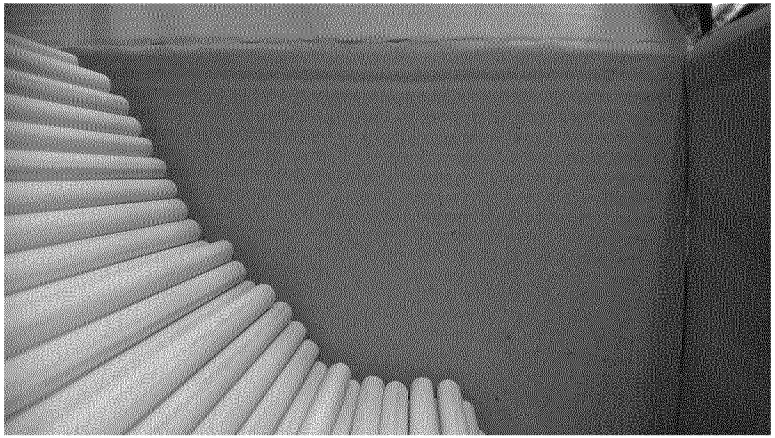
Figure 6B:
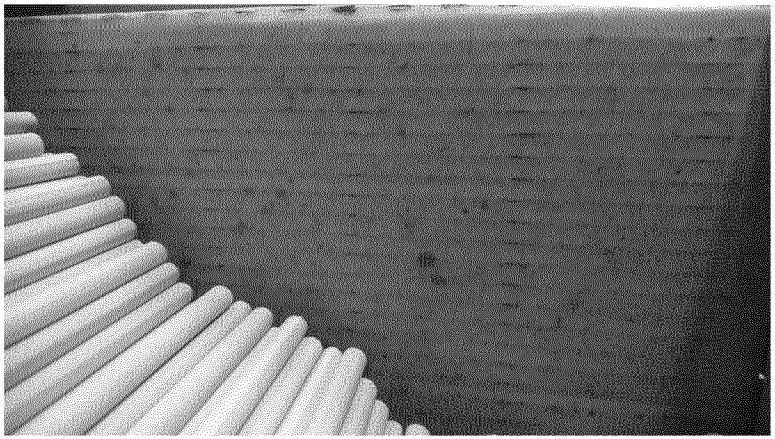

The samples 11 to 13 and the control filter were prepared in Indonesia and air-shipped to Germany, where they were placed upright on a cardboard tray and stored for 180 days at 22° C., standard pressure and 50% relative humidity. After the 180-day storage, stains on the cardboard trays were visible for samples 11, 12 and 13. These correspond to the amount of additive leaked over the storage period. Grayscale pictures of the cardboard trays for samples 11 to 13 and control 3 are shown in FIGS. 6*a* to 6*d*, where FIG. 6*a* shows control 3, FIG. 6*b* shows sample 11, FIG. 6*c* shows sample 12, and FIG. 6*d* shows sample 13. It can be readily observed that additive leakage for samples 12 and 13 and significantly lower than for sample 11. This confirms the observation of Example 1.

Reference Example 1

Film samples of different materials were cut to sizes with comparative weight, put into soil, and stored in a controlled room at 30° C. at 90% relative humidity and stored for 70 days. During that time, the weight loss thereof was determined after 10, 20, 30, and 70 days for determining the biodegradability. The results thereof are shown in Table 3, where weight is expressed as a percentage of the original weight of the sample.

TABLE 3

Results of biodegradability

| Material | Storage duration 0 days Weight [%] | 10 days Weight [%] | 20 days Weight [%] | 30 days Weight [%] | 70 days Weight [%] |
|---|---|---|---|---|---|
| Cellulose Acetate | 100 | 100 | 100 | 100 | 100 |
| Polylactic Acid | 100 | 99 | 98 | 97 | 96 |
| Polycaprolactone | 100 | 97 | 95 | 96 | 95 |
| Polybutylene Succinate | 100 | 98 | 99 | 98 | 98 |
| Polyvinyl Alcohol | 100 | 0 | 0 | 0 | 0 |
| Cellulose | 100 | 92 | 84 | 78 | 0 |

As can be seen from Table 3, the sample that was fastest to degrade was the polyvinyl alcohol sample, followed by the cellulose sample, which degraded at a significantly faster rate than the cellulose acetate, polylactic acid, polycaprolactone, and polybutylene succinate samples. The polyvinyl alcohol sample had completely degraded after 10 storage days, while more than 90% of the original weight of the remaining samples remained after the same storage period. The cellulose sample had degraded completely after 70 storage days, while more than 95% of the original weight of the cellulose acetate, polylactic acid, polycaprolactone, and polybutylene succinate samples remained after the same storage period.

This shows, among others, that polylactic acid, as well as cellulose acetate, is not sufficiently biodegradable, whereas cellulose is.

The invention claimed is:

1. A filter for a smoking article, the filter comprising:

a segment comprising a filtration substrate and a composition, wherein the filtrate substrate comprises natural cellulose fibres, and the composition comprises an additive for reducing phenols, and a binder agent for binding the additive to the filtration substrate; and a wrapper at least partly surrounding the segment, wherein the additive for reducing phenols is triacetin and is contained in an amount of between 19 wt. % and 21 wt. % or between 28 wt. % and 32 wt. %, based on a total amount of the filtration substrate and the composition, and the binding agent is cellulose acetate and is contained in an amount of between 0.2 wt. % and 5.0 wt. %, based on the total weight of the filtration substrate and the composition.

2. The filter of claim 1, wherein the composition comprises less than 20 wt. % of the binding agent, based on a total weight of the composition.

3. The filter of claim 1, wherein a ratio of a total weight of the binding agent to a total weight of the filtration substrate is 5/1000 or higher.

4. The filter of claim 1, wherein the binding agent is contained in an amount of 0.6% or higher, based on the total weight of the filtration substrate and the composition.

5. The filter of claim 1, wherein the composition is contained in an amount such that a filtration selectivity of the segment for phenol over total particulate material is at least 2, where the filtration selectivity $S_x$ is defined by the formula:

$$S_X = \frac{1 - E[TPM]}{1 - E[\text{Phenol}]}$$

where E[TPM] is filtration efficiency of the segment for total particulate material, and E[Phenol] is filtration efficiency of the segment for phenol.

6. The filter of claim 1, wherein the composition is contained in an amount of 10 wt. % to 35 wt. %, based on the total weight of the filtration substrate and the composition.

7. A smoking article, comprising the filter of claim 1.

8. The filter of claim 1, wherein the degree of substitution of cellulose acetate is between 2.1 and 2.9.

9. A method for producing a filter rod, the method comprising the steps of:

providing a filtration substrate comprising natural cellulose fibres;

forming the filtration substrate into a continuous rod;

applying a composition to the filtration substrate, the composition comprising an additive for reducing phenols, and a binder agent for binding the additive to the filtration substrate;

wrapping the continuous rod with a continuous band of a wrapping material; and cutting the wrapped continuous rod to obtain filter rods of a predetermined rod length, wherein the additive for reducing phenols is triacetin and is contained in an amount of between 19 wt. % and 21 wt. % or between 28 wt. % and 32 wt. %, based on a total amount of the filtration substrate and the composition, and the binding agent is cellulose acetate and is contained in an amount of between 0.2 wt. % and 5.0 wt. %, based on the total weight of the filtration substrate and the composition.

10. The method of claim 9, wherein the step of applying the composition to the filtration substrate is performed during or after the step of forming the filtration substrate into the continuous rod.

11. The method of claim 9, wherein the step of applying the composition to the filtration substrate is performed during or after the step of wrapping the continuous rod.

12. The method of claim 9, wherein the step of applying the composition to the filtration substrate is performed before the step of forming the filtration substrate into the continuous rod.

13. The method of claim 9, wherein the step of applying the composition to the filtration substrate comprises spraying the composition onto the filtration substrate.

14. The method of claim 9, further comprising a step of heating the composition before or during the step of applying the composition to the filtration substrate.

* * * * *